United States Patent [19]

Fukuzawa et al.

[11] Patent Number: 4,827,276

[45] Date of Patent: May 2, 1989

[54] MICROWAVE ANTENNA

[75] Inventors: Keiji Fukuzawa, Chiba; Fumihiro Ito, Kanagawa; Junichi Kajikuri, Kanagawa; Shinobu Tsurumaru, Kanagawa, all of Japan

[73] Assignee: Sony Corporation, Tokyo, Japan

[21] Appl. No.: 58,286

[22] Filed: Jun. 4, 1987

[30] Foreign Application Priority Data

Jun. 5, 1986 [JP] Japan ..... 61-130937
Jun. 9, 1986 [JP] Japan ..... 61-133037
Jun. 10, 1986 [JP] Japan ..... 61-134651

[51] Int. Cl.[4] ..... H01Q 13/00

[52] U.S. Cl. ..... 343/778; 343/769; 343/786

[58] Field of Search ..... 343/778, 700 MS, 777, 343/769, 771, 799, 797, 786

[56] References Cited

U.S. PATENT DOCUMENTS 3,665,480 5/1972 Fassett ..... 343/754
4,208,660 6/1980 McOwen, Jr. ..... 343/769
4,291,311 9/1981 Kaloi ..... 343/700 MS
4,486,758 12/1984 DeRonde ..... 343/700 MS
4,543,579 9/1985 Treshirogi ..... 343/700 MS
4,614,947 9/1986 Rommos ..... 343/778
4,626,865 12/1986 Rommos ..... 343/786
4,644,362 2/1987 Rommos ..... 343/786
4,680,591 7/1987 Axford et al. ..... 343/895

FOREIGN PATENT DOCUMENTS 0108463 5/1984 European Pat. Off. .
0123350 10/1984 European Pat. Off. .
0134611 3/1985 European Pat. Off. .
0215240 3/1987 European Pat. Off. .

*Primary Examiner*—William L. Sikes
*Assistant Examiner*—Hoanganh Le
*Attorney, Agent, or Firm*—Hill, Van Santen, Steadman & Simpson

[57] ABSTRACT

A planar microwave antenna of the suspended line feed type has a substrate sandwiched between a pair of conductive plates, each of the plates having aligned openings defining radiation elements. The substrate is held in place by holding portions surrounding the openings and wide grooves between the openings house a plurality of parallel suspended lines.

11 Claims, 10 Drawing Sheets

MICROWAVE ANTENNA

FIELD OF THE INVENTION

The present invention relates to microwave antennas, and more particularly to planar antennas for receiving circularly polarized waves of a high frequency satellite broadcasting transmission.

DESCRIPTION OF THE PRIOR ART

A number of designs have been proposed for high frequency planar antennas, particularly with respect to antennas intended to receive satellite transmissions in the 12 GHz band. One previous proposal is for a microstrip line feed array antenna, which has the advantage that it can be formed by etching of a substrate. However, even when a low loss substrate such as a teflon or the like is used, there are considerable dielectric losses and radiation losses from this type of antenna. Accordingly, it is not possible to realize high efficiency, and when a substrate is used having a low loss characteristic, the cost is relatively expensive.

Other proposed antenna designs are a radial line slot array antenna, and a waveguide slot array antenna. These antennas tend to have reduced dielectric and radiation losses, as compared to the microstrip line feed array antenna. However, the structure is relatively complicated so that production of this antenna design becomes a difficult munfacturing problem. In addition, since each of these designs is formed as a resonant structure, it is very difficult to obtain a gain over a wide passband, for example, 300 to 500 MHz. Furthermore, these designs are complicated by the cost of coupling between slots, which makes it very difficult to obtain a good efficiency characteristic.

Another proposal is for a suspended line feed aperture structure array. This design has a structure which overcomes some of the foregoing defects, and can also provide a wide band characteristic, using an inexpensive substrate. Suspended feed line antennas are illustrated in European Patent Application No. 108463-A and 123350-A, and in MSN (Microwave System News), published March 1984, pp. 110-126.

The antenna disclosed in the first of the above applications incorporates copper foils which have to be formed perpendicularly relative to both surfaces of a dielectric sheet which serves as the substrate. Since the structure is formed over both surfaces of the substrate, the interconnection treatment becomes complicated, and the antenna is necessarily relatively large in size.

The antenna disclosed in the other above-cited application requires copper foils to be formed on two separate dielectric sheets. It is difficult to get accurate positioning of these foils, and the construction becomes relatively complicated and expensive. In the antenna disclosed in the MSN publication, one excitation probe is formed in each of a plurality of openings to form an antenna for a linear polarized wave. Such an antenna cannot effectively be used to receive a circular polarized wave, because the gain is poor, and two separate substrates must be used, making the construction relatively complicated and expensive.

Further, the assignee of the present invention has previously proposed a circular polarized planar array antenna of a video passband and high efficiency (United States patent application Ser. No. 888,117). This antenna is in the form of a suspended line feed type planar antenna having a substrate sandwiched between a pair of metal sheets such as aluminum and metalized plastics, each of the metal sheets having a plurality of spaced openings defining radiation elements. In this antenna, a plurality of openings having a pair of excitation probes are formed perpendicularly to each other in a common plane and signals received at the pair of excitation probes are supplied to the suspended line in phase with each other.

This previously proposed circular polarized wave planar array antenna will be described with reference to FIGS. 1 to 5.

FIG. 1 is a plan view of a circular polarized wave radiation element used in such an antenna, whereas FIG. 2 is a cross-sectional view taken along a line I—I in FIG. 1.

Referring to FIGS. 1 and 2, an insulating substrate 3 is sandwiched between first and second metal plates 1 and 2 (which may be formed of metal sheets or plates such as aluminum or metalized plastic). A number of openings 4 and 5 are formed in the plates 1 and 2, the opening 4 being formed as a concave depression or recess in the plate 1 and the opening 5 being formed as an aperture in the plate 2.

A pair of excitation probes 8 and 9, oriented perpendicular to each other, are formed on the substrate 3 in a common plane, in alignment with the openings 4 and 5 as illustrated in FIG. 1. The excitation probes 8 and 9 are each connected with a suspended line conductor 7 located within a cavity portion 6 which forms a coaxial line for conducting energy between the excitation probes 8 and 9 and a remote point. The substrate 3 is in the form of a thin flexible film sandwiched between the first and second metal or metalized plates 1 and 2. Preferably, the openings 4 and 5 are circular, and of the same diameter, and the upper opening 5 is formed with a conical shape as illustrated in FIG. 2.

The suspended line conductor 7 comprises a conductive foil supported on the substrate 3 centrally in the cavity portion 6 to form a suspended coaxial feed line.

FIG. 3 is a cross-sectional view taken along a line II—II in FIG. 2. As illustrated in FIG. 3, the conductive foil 7 forms the central conductor and the conductive surface of the plates 1 and 2 form the outer coaxial conductor.

Preferably, the foil 7 is formed as a printed circuit by etching a conductive surface on the substrate 3, so as to remove all portions of the conductive surface except for the conductive portions desired to remain such as the foil 7, and the excitation probes 8 and 9, etc. Preferably, the conductive foil has a thickness of, for example, 25 to 100 micrometers. Since the substrate 3 is thin and serves only as a support member for the foil 7, even though it is not made of low loss material, the transmission loss in the coaxial line is small. For example, the typical transmission loss of an open strip line using a teflon-glass substrate is 4 to 6 dB/m at 12 GHz, whereas the suspended line has a transmission loss of only 2.5 to 3 dB/m, using a substrate of 25 micrometers in thickness. Since the flexible substrate 3 is inexpensive, as compared with the teflon-glass substrate, this arrangement is much more economical.

In FIG. 3, t designates the thickness of the substrate 3, L the width of the cavity portion 6, d the height of the cavity portion 6 and W the width of the suspended line conductor 7. Then, in the known circular polarized wave radiation element t is 25 micrometers, d is 1.4 mm, L is 2 mm and W is 1 mm in practice. Under a frequency of 12 GHz, a transmission loss is about 3 dB/m as shown by a dashed line a in FIG. 4.

FIG. 5 illustrates that the conductive foil 7 is formed into elongate feed lines, arranged perpendicular to each other, where they are connected to the excitation probes 8 and 9, and connected together by a common leg. The foils are connected to a feed line at the point 11, which is offset relative to the center of the common leg, as shown in FIG. 5, so that the excitation probe 9 is fed by a line having a longer length, indicated by reference numeral 10, of one quarter of wavelength, relative to the length of the feed in the excitation probe 8. The wavelength referred to here (and elsewhere in this application) is the wavelength of energy within the waveguide or suspended line 7, indicated by $\lambda g/4$, which wavelength is determinable from the frequency of the energy and the geometry of the waveguide. With this arrangement, (considering the antenna as a transmitting antenna) a circular polarized wave results, as the result of linear polarized waves launched from the excitation probes 8 and 9 which are out of phase by $\pi/2$ (90°), or one quarter wavelength.

As illustrated in FIG. 5, the phase of the signal applied to the excitation probe 8 (as a transmitting antenna) is advanced by a quarter of the wavelength (relative to the center frequency of the transmission band) compared with that applied to the excitation probe 9. This arrangement, when used as a receiving antenna, allows a clockwise circular polarized wave to be received, since the excitation probe 8 comes into alignment with the rotating E and H vectors of the wave one quarter cycle after the excitation probe 9 is in such alignment. Because of the increased length 10 of the foil line connected with the excitation probe 9, the excitation probes 8 and 9 contribute nearly equal in-phase components to a composite signal at the T or combining point 11.

If the extra length 10 were inserted in the foil line 7 connected with the excitation probe 8, then the arrangement would receive a counter-clockwise circular polarized wave. It will be apprehended that this can be effectively accomplished merely by turning over the sheet 3 on which the excitation probes 8 and 9 and the feed lines 7 are supported, so that the structure of this antenna can receive both kinds of circular polarization, with slight modification during assembly.

FIG. 6 illustrates a circuit arrangement in which a plurality of radiation elements, each like that illustrated in FIGS. 1-5 are interconnected by foil lines printed on the sheet 3. Each of the radiation elements contributes a signal in phase with the signal contributed by every other radiation element, which are interconnected together at a feed point 12. It will be apprehended from an examination of FIG. 6 that the length of the foil line 7 from the point 12 to any of the individual excitation probes 8 and 9, constitutes an equal distance, so that the signals received from each radiation element arrive at the feed point 12 in phase with the others. The array of FIG. 6 shows the printed surface on the substrate 3, and the aligned position of the openings 4 in the plate 2. The substrate 3 is sandwiched between the conductive plates 1 and 2 having the openings 4 and 5 (FIG. 2) aligned with each of the radiation elements, so that all of them function in the manner described above in connection with FIGS. 1 to 5. Using the general arrangement illustrated in FIG. 6, it is possible to obtain various radiation patterns, by changing characteristics of the lines. For example, if the distance from the common feed point 12 to the excitation probes 8 and 9 of some of the radiation elements is changed, the phase of the power contributed by those radiation elements can be changed. Further, if the ratio of impedance is changed by reducing, or increasing the thickness of the suspended lines at the places where it is branched (as shown in FIG. 5), it is possible to change the amplitude of the signals contributed from the branches to the common line of the branch. This affects the relative power and phase of the signals contributed from each of the receiving elements, with the result of changing the radiation pattern of the antenna.

FIG. 7 is a cross-sectional view taken along a line III—III in FIG. 6. A dashed line in FIG. 7 illustrates that the circuit in FIG. 6 is covered with the second metal plate 2. It will be apphrehended from FIG. 7 that the cavity portions 6 are made in alignment with individual conductor foils 7.

The above mentioned circular polarized planar array antenna, however, has the following shortcomings.

The spacing between horizontally-adjacent radiation elements must be selected in the range from 0.9 to 0.95 wavelength relative to 12 GHz wave in free space (ranging from 22.5 to 23.6 mm) in order to obtain high gain (high efficiency). This causes the width of the groove of the suspended line interconnected through the radiation elements, or the width of the cavity portion 6 to be limited under about 2 mm, thus putting a limitation on decreasing the transmission loss. Further, in order to assure sufficient width of the groove, the freedom in designing the antenna is restricted. Furthermore, the groove (cavity portion) having a narrow width must be formed on the whole of the array surface along the conductive foil, so that the manufacturing process is complicated and that strict accuracy is required because the groove must be sandwiched by the metal plates 1 and 2. In addition, the accuracy of the dimension required for removal of metal and for forming the metalized plastic plate is difficult to assure particularly for the massproduction. This problem becomes serious for the groove portion of the suspended line.

Further, though not described in practice, because of the construction of an antenna as described above, the antenna can be made very thin, and with a simple mechanical arrangement. Even when inexpensive substrates are used, the gain obtained from the antenna is equal to or greater than that of an antenna which uses the relatively expensive microstrip line substrate technology.

When the spacing of the radiation elements is selected in the range from 0.9 to 0.95 wavelength relative to a 12 GHz wave in free space (ranging from 22.5 to 23.6 mm), the width of the cavity portion for the suspended line is selected as 1.75 mm, and the diameter of the radiation element or the openings 4 and 5 formed in the plates 1 and 2 is selected as 16.35 mm. However, for most effective reception of the satellite broadcasting frequency band (11.7 to 12.7 GHz) it is desirable to select the line width to be wider than 2 mm, and a reduced diameter of the radiation element. For example, for most effective reception, the diameter must be reduced from 16.35 to about 15.6 mm.

However, if the diameter of the radiation element is selected as small as about 15.6 mm, the cut-off frequency of the dominant mode ($TE_{11}$ mode) of the circular waveguide having this diameter becomes about 11.263 GHz. As a result, it becomes difficult to achieve impedance matching between the cavity portion formed by the openings 4 and 5 and the excitation probes 8 and 9, and the antenna becomes relatively narrow in band width. Thus, the characteristics of the return losses change, with the result that the return loss near the operation frequency (11.7 to 12.7 GHz) deteriorates. The "return loss" refers to the loss resulting from reflection due to unmatched impedances. Therefore, the assignee of the present invention previously proposed a suspended line feed type planar array antenna of the same structure which is particularly provided with conductive segments which are aligned with the excitation probes within each radiation element in order to obtain better impendance matching (see United States patent application Ser. No. 888,117.

Particularly when a line is used as a strip line feed system of various planar array antennas used to receive satellite broadcasting transmitted on 12 GHz wave band, the loss caused by the feed line is a main factor which determines the antenna gain (operation gain). This becomes serious, particularly when a gain of 30 dB or more is obtained.

Accordingly, if a feed line having a small loss is realized, the afore-mentioned problems can be solved to some extent. However, when the feed circuit network for receiving a circular polarized wave is supplied with a power and phase as mentioned before, if the spacing between the adjacent radiation elements is selected in a range from 0.9 to 0.95 wavelength in order to obtain the maximum gain, the width of the groove constructing the suspended line is about 2 mm for 12 GHz wave band. Thus, the transmission loss is large.

In other words, because of the spacing between the elements and the circular polarized wave mixing section for obtaining the high gain, the line width is selected to be constant and narrow, so that the feed loss (transmission loss) cannot be minimized. Further, even though the diameter of the radiation element is reduced and the width of the feed line is increased as much as possible under the condition that the spacing between the radiation elements is made constant, there still remains a limit on minimizing the transmission loss.

A satellite broadcasting reception system generally comprises a reception antenna located outdoors, a converter of low noise, a connection cable and a receiver located indoors, electrically connected through the connection cable to thereby receive a television picture and sound. A parabolic antenna is normally employed as a reception antenna and includes a primary radiator located at the focus point to derive radio waves collected by a reflection mirror and a succeeding converter of low noise.

On the other hand, the assignee of the present invention has previously proposed a planar array antenna to receive a satellite broadcasting (see United States patent application Ser. No. 888,117). In this previously proposed planar array antenna, excitation probes are provided on a substrate in a common plane, in alignment with the number of openings, with each forming one portion of a radiation element, and one radiation element near the probe of the central portion is removed and replaced by a feed point, whereby the transmission loss of the feed line is reduced and the antenna is simplified in construction and becomes high in gain and more economical.

When an antenna like a parabolic antenna is used to receive a satellite broadcasting, the apparatus is located in three-dimensional space, so that the mounting of the antenna becomes difficult and that a large space is required. In addition, since a primary radiator and a converter of low noise type are both located in the curved surface within the space, the performance of the antenna is affected by the snowfall or the like and thereby deteriorated in efficiency.

OBJECTIONS AND SUMMARY OF THE INVENTION

Accordingly, it is a general object of this invention to provide a planar array antenna to transmit or receive an electromagnetic wave, while attaining simplicity of construction, low-cost and excellent performance characteristics.

It is an object of this invention to provide a circular polarized wave planar array antenna in which a substrate is sandwiched between conductive plates having a plurality of openings, with a pair of perpendicular excitation probes being located in alignment with each opening, with signals from the excitation probes being combined in a predetermined phase relationship with each other.

It is another object of this invention to provide a circular polarized wave planar array antenna in which two additional conductive elements are provided in alignment with the excitation probes to provide improved impedance matching relative to the openings in the conductive layers.

It is still another object of this invention to provide a circular polarized wave planar array antenna in which a connection network is associated with each pair of excitation probes, comprising a pair of feed lines each having a length of a quarter wavelength and a resistance element interconnected between such feed lines.

It is a further object of this invention to provide a circular polarized wave planar array antenna in which the feed point of the antenna array is located near the center thereof, and occupies the position normally occupied by one of the pairs of excitation probes.

It is still further object of this invention to provide a circular polarized wave planar array antenna which further comprises a holding portion being provided around each of a plurality of openings to hold a substrate and a groove portion of wide width being formed between adjacent openings, in such a fashion that a plurality of suspended lines are provided in parallel to each other within some of the groove portions.

It is yet a further object of this invention to provide a converter waveguide structure which can be attached to a circular polarized wave planar array antenna of the invention.

According to one aspect of the present invention, there is provided a suspended line feed type planar array antenna having a substrate sandwiched between a pair of conductive plates, each of said plates having a plurality of spaced openings defining radiation elements, a plurality of said openings having a pair of excitation probes formed perpendicular to each other in a common plane, on said substrate, in alignmnent with said openings, means for connecting signals received at said pair of excitation probes to a suspended line in phase with each other, a holding portion for holding said substrate formed on said conductive plate around each of said plurality of openings and a groove portion of wide width formed on said conductive plates between said adjacent openings, wherein a plurality of said suspended lines are located in parallel with each other within some of said groove portions.

These and other objections, features and advantages of the present invention will become apparent from the following detailed description of the preferred embodiments that are to be read in conjuction with the accompanying drawings, in which like reference numerals identify like elements and parts.

DESCRIPTION OF THE PREFERRED EMBODIMENTS

Now, the present invention will hereinafter be described in detail with reference to the drawings.

Figure 6:
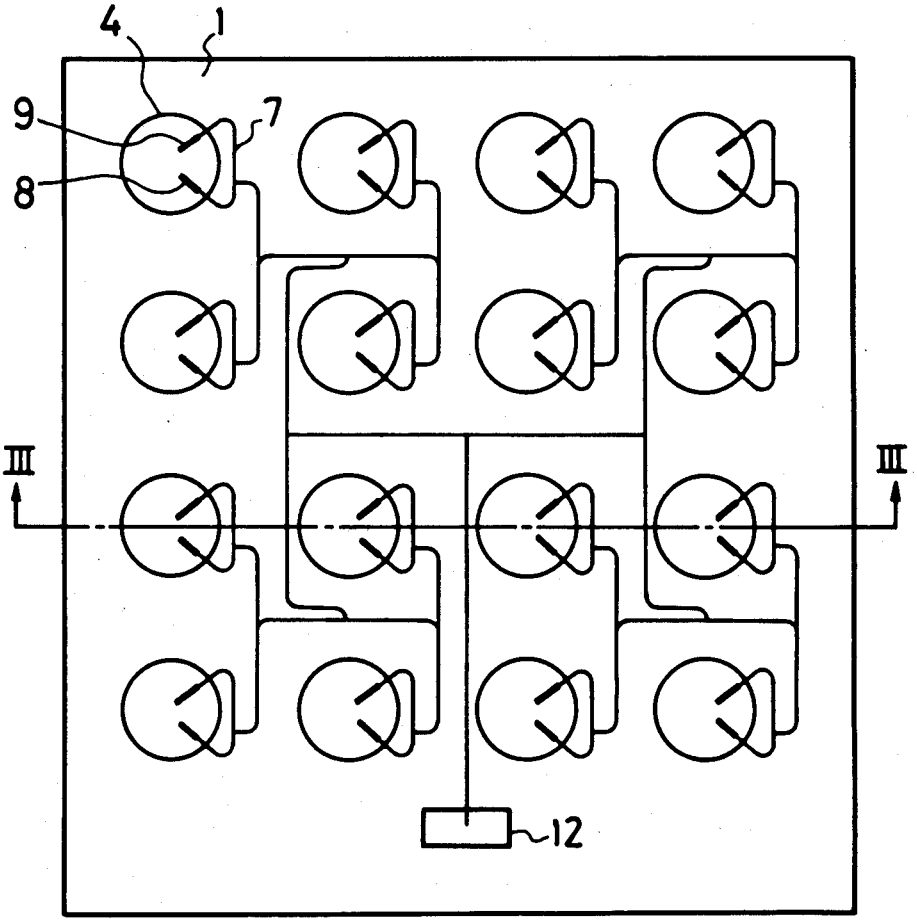
FIG. 6 (PRIOR ART)
FIG. 6 is a plan view illustrating the interconnection of a plurality of radiation elements.
Figure 7:
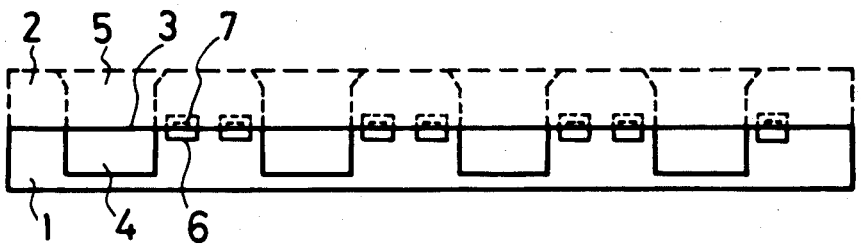
FIG. 7 (PRIOR ART)
FIG. 7 is a cross-sectional view taken along the line III—III in FIG. 6.
Figure 8:
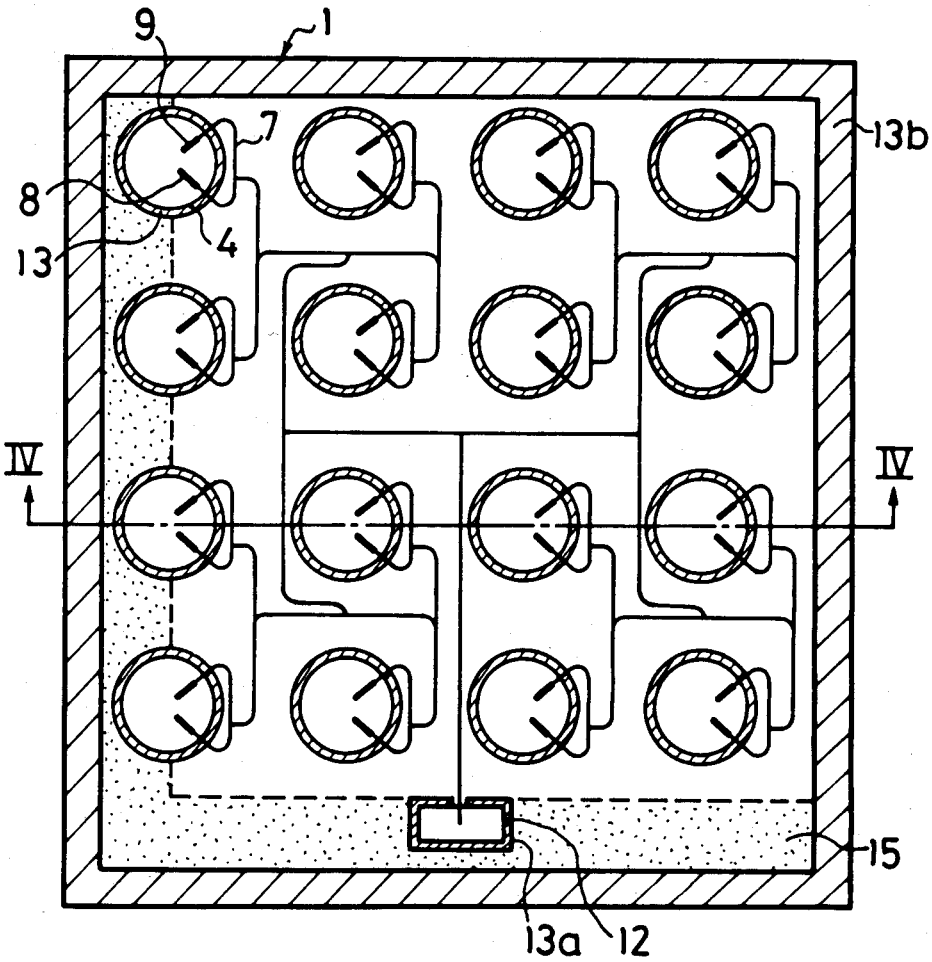
FIG. 8 is a plan view illustrating an embodiment of the interconnection of a plurality of radiation elements according to the present invention.
Figure 9:
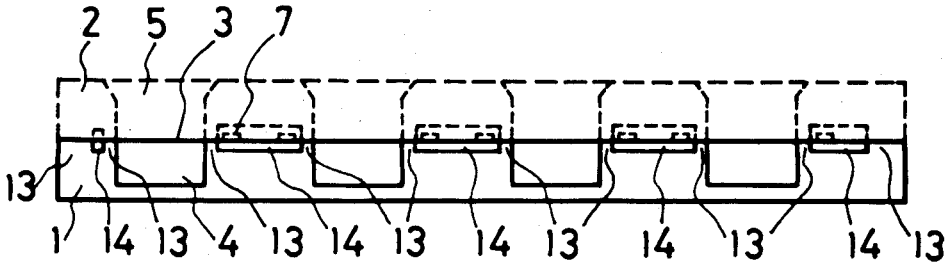
FIG. 9 is a cross-sectional view 8 taken along the line IV—IV in FIG. 8.

FIG. 8 illustrates an embodiment of the present invention in which a plurality of circular polarized wave radiation elements (FIGS. 1 to 5) are powered all in phase, from a feed point 12. In FIG. 8, like parts corresponding to those of FIG. 6 are marked with the same reference numerals and therefore need not be described in detail. FIG. 9 is a cross-sectional view taken along a line VI—VI in FIG. 8. A dashed line in FIG. 9 illustrates that the second metal plate 2 is put on the array of FIG. 8 during assembly.

In this embodiment, as shown in FIGS. 8 and 9, around each of the openings 4 bored through the first metal plate 1, there is provided a holding portion 13 to hold the substrate 3. Further, around the feed portion 12 formed through the metal plate 1, there is provided a holding portion **13*a* to hold the substrate 3. Also, a holding portion 13*b* is formed over the outer peripheral portion of the array. Other remaining portions are formed to have a depth equal to, for example, that of the cavity portion 6 shown in FIG. 2 to thereby form a groove, or cavity portion 14 on the metal plate 1 as shown in FIG. 9. There is then a possiblity that a plurality of conductor foils 7 will be coupled because they are provided within the same cavity portion 14. Such a possiblity, however, can be removed by selecting the distance between the conductive foils 7 and a space between the upper and lower walls of the cavity portion 14 to thereby establish the necessary isolation therebetween. At that time, electric lines of force concentrate on the upper and lower walls of the cavity portion 14, thus substantially removing electric field generated along the substrate 3**. As a result, dielectric loss is reduced, with the result that the transmission loss of the suspended line is reduced.

Referring to FIG. 8, there is shown an area 15 through which no suspended line is passed. Accordingly, the area 15 need not be decreased in thickness to form a cavity portion, but be left as a holding portion. In this case, the feed portion 12 need not have therearound the special holding portion **13*a* and the area 15 serves as the holding portion. If the feed portion 12 is provided at the portion at which a central radiation element is removed in order to reduce the transmission loss by reducing the length of the feed line (see United States patent application Ser. No. 888,117), the special holding portion 13*a* is provided around the feed portion 12 as illustrated in FIG. 8**.

The holding portions and the cavity portions are formed on the second metal plate 2 in alignment with those of the first metal plate 1. Though not shown, the holding portions are formed around each of the openings 5 bored through the second metal plate 2, around the feed portion (its upper surface is closed) and around the outer peripheral portion of the antenna array. Other portions are formed to have a concave depression or recess so as to form the cavity portions.

Since the substrate 3 is uniformly held by the holding portions 13, **13*a* and 13*b*, the substrate 3 is prevented from being deformed. In addition, the first and second metal plates 1 and 2** closely sandwich the perimeters of the radiation elements, the feed portion and so on, avoiding the occurrence of resonance at a specific frequency.

Though not shown, a plurality of knock pins are formed on one of the first and second metal plates 1 and 2 at their portions through which the suspended lines are not passed and through-holes are formed through the substrate 3 and the other metal plate to receive with the above mentioned knock pins. Therefore, the positioning of the metal plates 1 and 2 and the substrate 3 can be made with ease by engaging the knock pins into the through-holes.

According to this embodiment, since the common cavity portion is substantially formed by removing the partition wall of the cavity portion at every line in the prior art, the planar array antenna does not require so high an accuracy, it can be manufactured with ease by machinery. Further, the freedom in designing the suspended line is increased and the transmission loss is reduced, with the result that the gain (or efficiency) of the antenna can be increased.

According to the above embodiment of the present invention, as set forth above, since the holding portions are formed around a great number of openings, each forming a portion of the radiation element, and since the cavity portion is provided at least between the adjacent openings as a groove portion, the suspended line is not from being restricted by the cavity portion, so that the array antenna can be mechanically processed and molded with ease and the accuracy of the dimension thereof can be relieved. The transmission loss of the line is decreased, with the result that the antenna gain (or efficiency) can be increased. Further, the planar array antenna can be improved by a single thin film-shaped substrate and can receive circularly polarized waves. Furthermore, since the substrate of a thin film is substantially held by the holding portions formed around the circular radiation elements, the suspended line can be constructed uniformly. In addition, since the perimeters of the circular radiation element and the feed portions are closely sandwiched between the upper and lower metal plates, the occurrence of the resonance or the like at a specific frequency can be avoided.

Another embodiment of the circular polarized wave planar array antenna according to the present invention will be described hereinafter.

Figure 1:
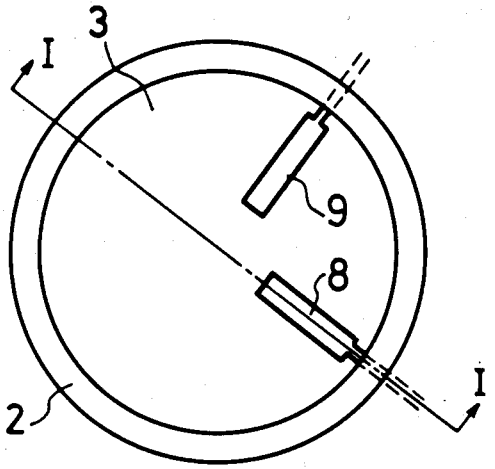
FIG. 1 (PRIOR ART)
FIG. 1 is a top view of an example of a known circular polarized wave radiation element.
Figure 2:
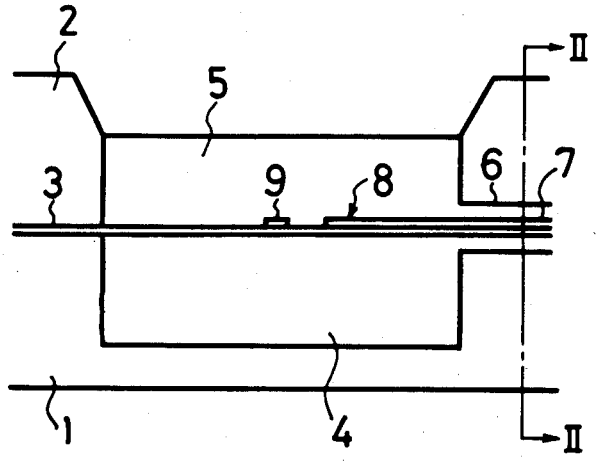
FIG. 2 (PRIOR ART)
FIG. 2 is a cross-sectional view taken along the line I—I in FIG. 1.
Figure 10:
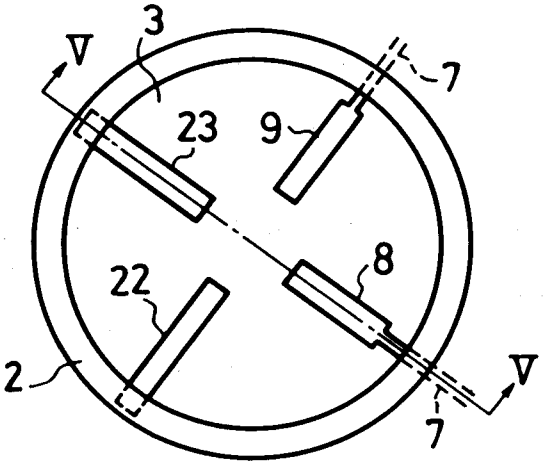
FIG. 10 is a top view illustrating another embodiment of the circular polarized wave radiation element.
Figure 11:
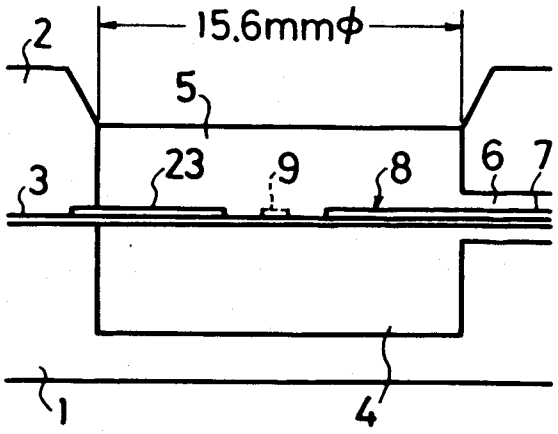
FIG. 11 is a cross-sectional view taken along the line V—V in FIG. 10.

FIGS. 10 and 11 illustrate the arrangement of the circular polarized wave radiation element used in this embodiment. FIG. 10 is a plan view and FIG. 11 is a cross-sectional view taken along a line V—V in FIG. 10. In FIGS. 10 and 11, like parts corresponding to those of FIGS. 1 and 2 are marked with the same references and therefore need not be described in detail.

Referring to FIGS. 10 and 11, the insulating substrate 3 is sandwiched between the metal plates 1 and 2 (which may be formed of sheet metal such as aluminum or metalized plastic). A number of openings 4 and 5 are formed in the plates 1 and 2, the opening 4 being formed as a concave depression or recess in the plate 1 and the opening 5 being formed as an aperture in the plate 2.

A pair of excitation probes 8 and 9, oriented perpendicular to each other, are formed on the substrate 3 in a common plane, in alignment with the openings 4 and 5 as illustrated in FIG. 10. The excitation probes 8 and 9 are each connected with the suspended line conductor 7 located within the cavity portion 6 which forms a coaxial line for conducting energy between the excitation probes 8 and 9 and a remote point. The substrate 3 is in the form of a thin flexible film sandwiched between the first and second metal or metalized plates 1 and 2. Preferably, the openings 4 and 5 are circular, and of the same diameter, and the upper opening 5 is formed with a conical shape as illustrated in FIG. 11.

The suspended line conductor 7 comprises a conductive foil supported on the substrate 3 centrally in the cavity portion 6 to form a suspended coaxial feed line. The conductive foil 7 forms the central conductor and the conductive surface of the plates 1 and 2 form the outer coaxial conductor. With this arrangement, a circular polarized wave results, with the result that linear polarized waves are launched from excitation probes 8 and 9 which are out of phase by $\pi/2$ (90°), or one quarter wavelength.

Referring to FIG. 10, conductive metal segments 22 and 23 are aligned with the excitation probes 8 and 9 within each radiation element. These elements 22 and 23, as shown in FIGS. 10 and 11, are aligned end to end and in line with the excitation probes 8 and 9 and spaced apart therefrom. The conductive segments 22 and 23 are elongate, rectangular and are formed as printed circuits or otherwise deposted on the surface of the substrate 3. They extend beyond the perimeter of the opening 5 to be in electrical contact at one ends thereof with the metal plate 2. The use of the conductive segments 22 and 23 makes it possible to lower the cut-off frequency of the radiation element, and to improve the return loss, or VSWR (voltage standing wave ratio) of the conversion (excitation) probe from the suspended line to the waveguide mode. The isolation between the coupling probes 8 and 9 is greater than 20 dB, so the radiation element effectively receives (transmits) a circular polarized radiation in the same manner as described above.

Because of the conductive segments 22 and 23, the cut-off frequency is lowered, so that the matching can be established to improve the return loss. When the diameter of the openings 4 and 5 of the radiation element is selected as 15.6 mm, then a waveguide having a small diameter can be used, and the image suppression is improved.

Figure 12:
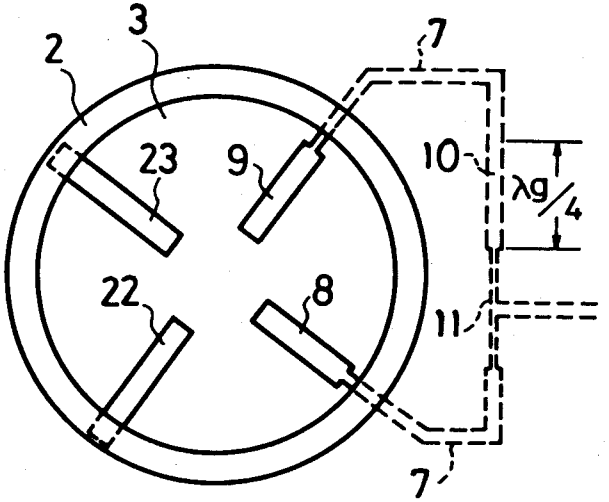
FIG. 12 is a top view of one of the radiation elements of the antenna of the invention, showing the suspended lines for feeding the excitation probes.

FIG. 12 is a diagram showing a practical circuit arrangement for combining circular polarized waves.

Referring to FIG. 12, a pair of excitation probes 8 and 9 are connected by the suspended line conductive foils 7 in a common plane on the substrate 3. In this case, a line 10 of $\lambda g/4$ (where $\lambda g$ is a line wavelength at the center frequency) corresponding to $\pi/2$ is connected to one of the foils 7 which is advanced in phase so that the waves becomes equal in phase at a composing section 11. This arrangement, when used as a receiving antenna, allows a clockwise circular polarized wave to be received, since the excitation probe 8 comes into alignment with the rotating E and H vectors of the wave one quarter cycle after the excitation probe 9 is in such alignment. Because of the increased length 10 of the foil line connected with the excitation probe 9, the excitation probes 8 and 9 contribute nearly equal-in phase components to a composite signal at the T or combining point 11.

If the extra length 10 were inserted in the foil line 7 connected with the excitation probe 8, then the arrangement would receive a counter-clockwise circular polarized wave. It will be apprehended that this can be accomplished merely by turning over the sheet 3 on which the excitation probes 8 and 9 and the feed lines 7 are supported, so that the structure of the embodiment of the present invention shown in FIG. 12 can receive both kinds of circular polarization, with slight modification during assembly.

Figure 13:
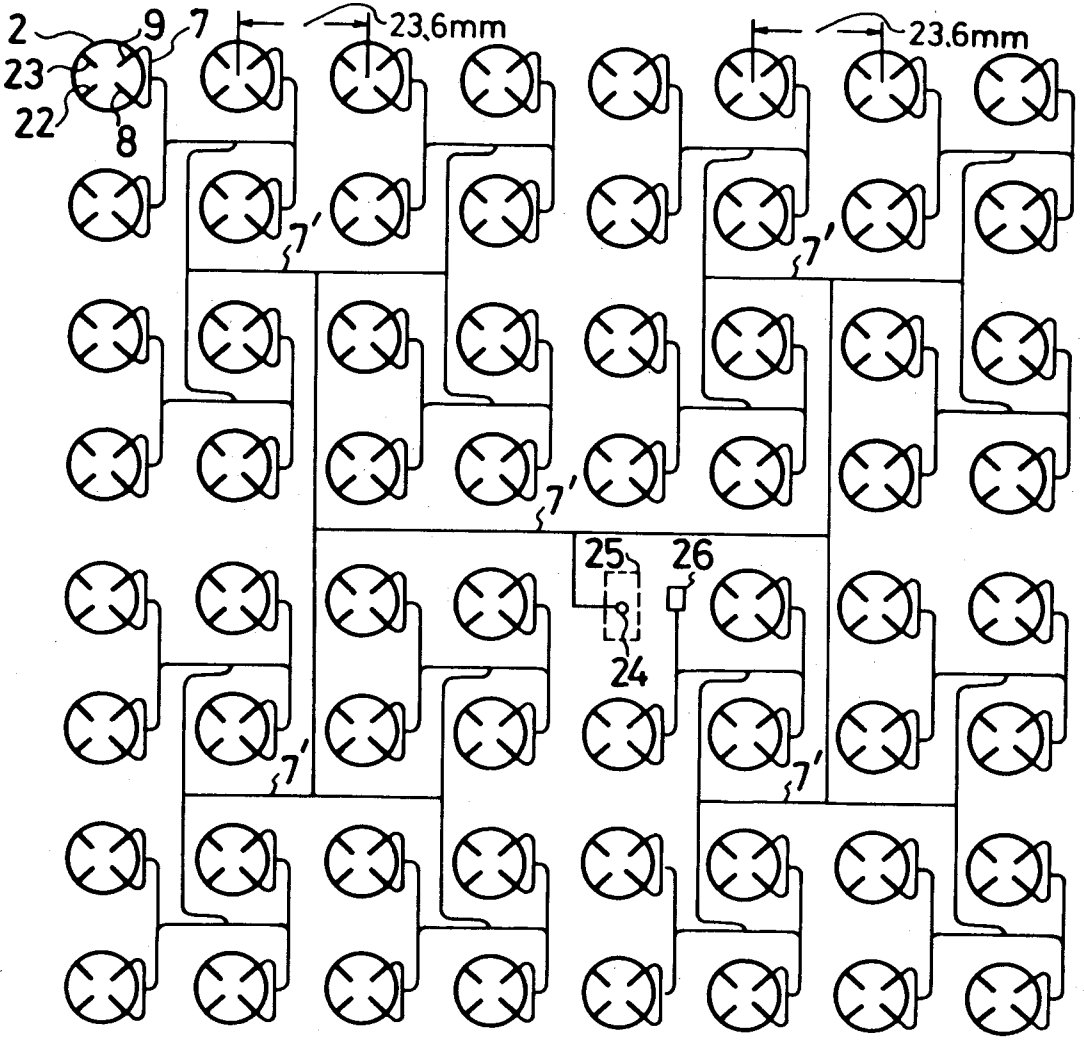
FIG. 13 is a plan view illustrating the interconnection of a plurality of radiation elements of the present invention.

Referring to FIG. 13, an array is illustraed in which a plurality of circular polarized wave radiation elements shown in FIG. 10 or 13 are powered through the suspended lines all in phase, from a common feed point 24. In practice, for a frequency of 12 GHz, the array is formed of 256 (16×16) circular polarized wave radiation elements. This array forms a square of 40 cm by 40 cm. In this case, a plurality of openings 4 and 5 are formed through the first and second metal plates 1 and 2 in alignment with the circular polarized wave radiation elements, respectively. The excitation probes 8 and 9 of the respective radiation elements are interconnected to the common feed point 24 via the suspended line conductive foils 7, in such a fashion that the lengths of the interconnecting lines are all equal in length.

With this arrangement, it is possible to obtain various radiation patterns, by changing characteristics of the lines.

For example, if the distance from the common feed point 24 to the excitation probes 8 and 9 of some of the radiation elements is changed, the phase of the power contributed by these radiation elements can be changed. Further, if the ratio of impedence is changed by reducing, or increasing the width of the suspended lines at the places where it is branched, it is possible to change the amplitude of the signals contributed from the branches to the common line of the branch and to thereby vary the directivity of the antenna.

As FIG. 13 shows, one of the radiation elements closest to the center of the array is removed, and a feed waveguide converter, the outline of which is shown in rectangular dashed box 25, is attached to the array at this point. A waveguide (not shown) is connected through this waveguide converter 25 to the common feed point 24. The transition from a rectangular waveguide to the coaxial line is made in the conventional way and therefore need not be described in detail. A resistor 26 is provided to terminate the line normally connected to the removed radiation element with the characteristic impedance of the feed line, to avoid any reflection effect by the removal of this radiation element. By using the arrangement of FIG. 13, the length of the feed line becomes shorter, so that the antenna gain lowered by the feed line can be improved.

In this embodiment, the width of the suspended lines where they are provided independently is increased as shown by reference numerals 7'. That is, the suspended line is formed of the cavity portion 6 and the conductive foil 7, so that if the suspended line is independently provided between the radiation elements, the width of the suspended line is increased. Referring to FIG. 13, the suspended line conductive foil 7' is independently provided between the radiation elements and the width thereof is made larger than that of other suspended lines 7. Of course, the width of the cavity portion 6 where the suspended line passes therethrough is increased accordingly, though not shown.

Figure 4:
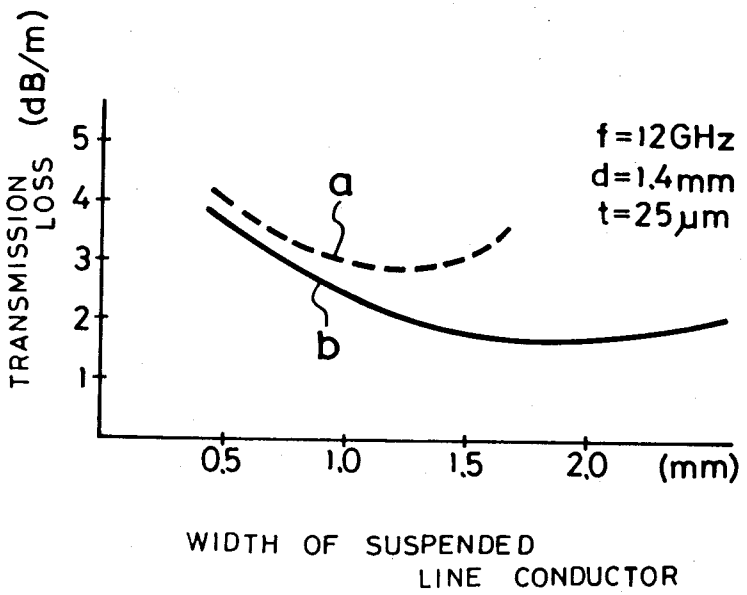
FIG. 4 is a graph used to explain a relationship between the width of suspended line conductor and transmission loss of the apparatus of FIGS. 1 and 2.
Figure 3:
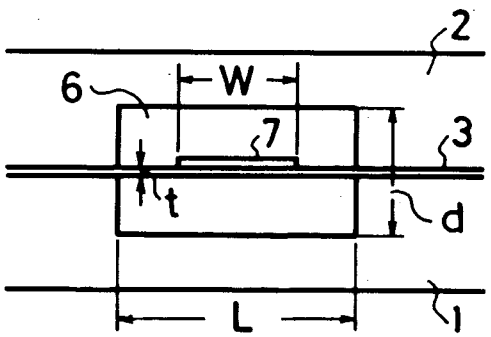
FIG. 3 (PRIOR ART)
FIG. 3 is a cross-sectional view taken along the line II—II in FIG. 2.
Figure 5:
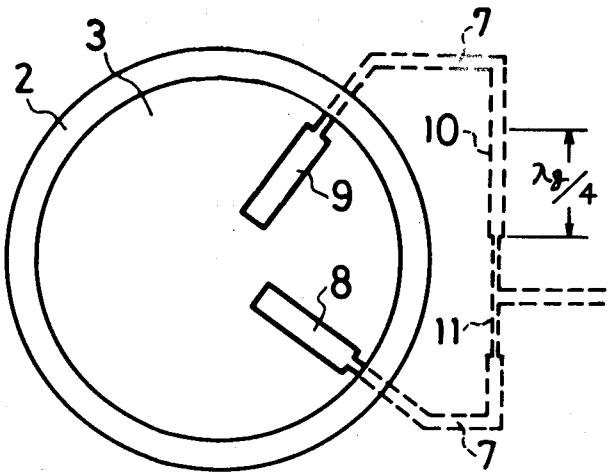
FIG. 5 (PRIOR ART)
FIG. 5 is a top view of one of the radiation elements of the known antenna, showing the suspended lines for feeding the excitation probes.

The effect of this embodiment will be described with reference to FIGS. 3 and 4. In FIG. 3, t designates the thickness of the substrate 3, L the width of the cavity portion 6, d the height of the cavity portion 6 and W the width of the suspended line conductor 7. Then, in the known circular polarized wave radiation element, t is 25 micrometer, d is 1.4 mm, L is 2 mm and W is 1 mm in practice. With a frequency of 12 GHz, the transmission loss is about 3 dB/m as shown by a dashed curve a in FIG. 4. When t is slected as 25 micrometers d as 1.4 mm, L as 4 mm and W as 2 mm as in the embodiment of the invention, with the frequency of 12 GHz, the transmission loss becomes about 1.8 dB/m as shown by solid curve b in FIG. 4. Accordingly, if the length of the portion in which the width of the suspended line conductor 7 can be increased is 50 cm, it becomes possible to increase the antenna gain by about 0.6 dB/m as compared with the prior art.

While the present invention is applied to the circular polarized wave planar array antenna as described above, the present invention is not limited to the circular polarized wave planar array antenna, but can be similarly applied to other planar antennas. Further, the present invention is not limited to the planar array antenna of the suspended line configuration but can be similarly applied to the planar antenna of the microstrip line configuration.

According to the above embodiment of the present invention, as set forth above, since the line width of the feed line such as the suspended line is increased in part, the loss of the feed line, or the transmission loss can be reduced and the antenna gain can be improved.

Figure 14:
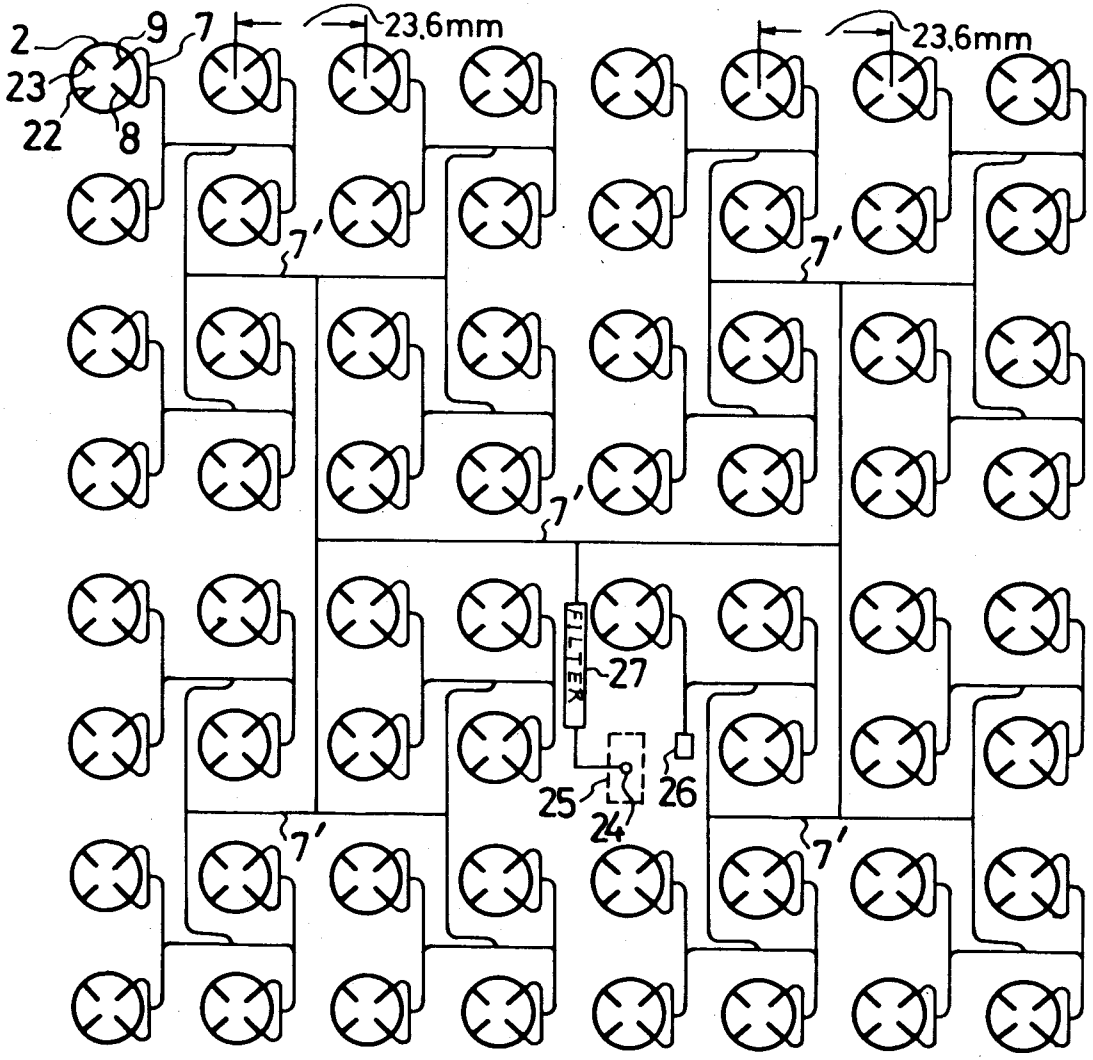
FIG. 14 is a plan view illustrating another embodiment of the film-shaped substrate according to the present invention.

FIG. 14 illustrates other embodiment of the film-shaped substrate 3 of the planar array antenna according to the present invention. In FIG. 14, like parts corresponding to those of FIG. 13 are marked with the same references and will not be described in detail.

Figure 15:
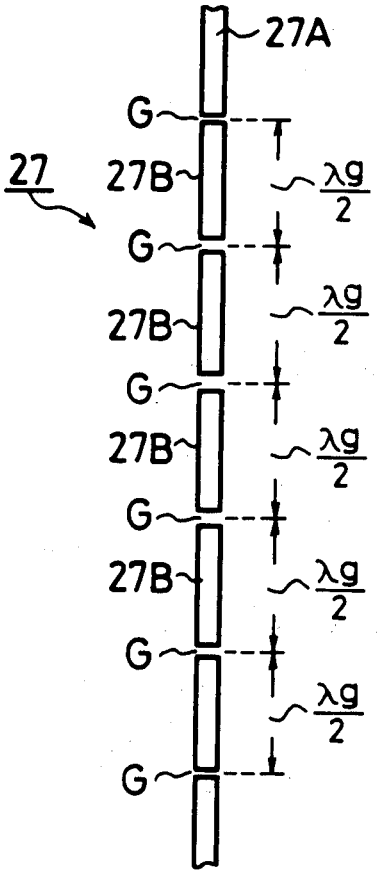
FIGS. 15 and 16 are respectively diagrams showing an arrangement of a filter used in the present invention.

As will be clear from the comparison of FIGS. 13 and 14, the position at which one of the radiation elements closest to the center of the array is removed in FIG. 13 is shifted down by one radiation element, and a filter 27 is provided just before the common feed point 24. This filter 27 is constructed by cutting a conductive foil 27A at a length of $\lambda g/2$ (for example $\lambda g/2 = 11.5 \sim 1.5$ cm) to provide island-shaped protions 27B as illustrated in FIG. 15. In this case, the length of a gap G between adjacent island-shaped portions 27B is selected to be narrower at the end portion and wider at the central portion (for example 0.1 mm at the edge portion and 1 mm at the central portion). As shown in FIG. 15, the filter 27 is formed of five island-shaped portions 27B but the filter 27 may be formed of two or three or more than 5 island-shaped portions 27B. Such a filter is called an end-coupled type filter and it is disclosed in Microwave Journal, July 1986, pp. 75-84.

Figure 16:
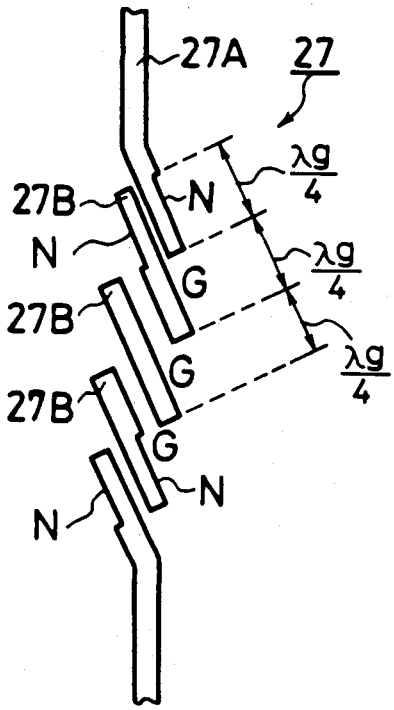

Alternatively, as shown in FIG. 16, the respective island-shaped portions 27B may be each located with an inclination of, for example, about 45°. In this case, notch portions N may be formed on the island-shaped portions 27B of both ends in order to effect the impedance matching. This type of filter is called a parallel-coupled type filter and it is disclosed in Microwave Journal, October 1980, pp. 67-71.

Figure 17:
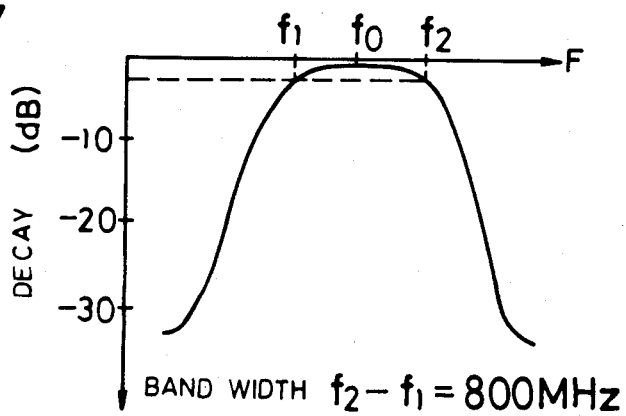
FIG. 17 is a graph showing the frequency characteristic of the filter shown in FIGS. 15 and 16.

The filter 27 shown in FIGS. 15 and 16 is designed as a bandpass filter with a bandpass characteristic having a band width, $f_1$–$f_2$ of 800 MHz around a desired frequency $f_0$ (ranging from 11.7 to 12.7 GHz) as shown in FIG. 17. The use of this filter 27 makes it possible to cut off undesired frequency components and to avoid various disturbances such as image interference and the like.

Further, in each of the embodiments shown in FIGS. 15 and 16, the filter 27 is formed with other elements at the same time on the common film-shaped substrate by using the conductive foils so that the arrangement of the filter 27 can be simplified considerably.

It is needless to say that the filter 27 can be formed together with the circuit arrangement shown in FIG. 6.

Figure 18:
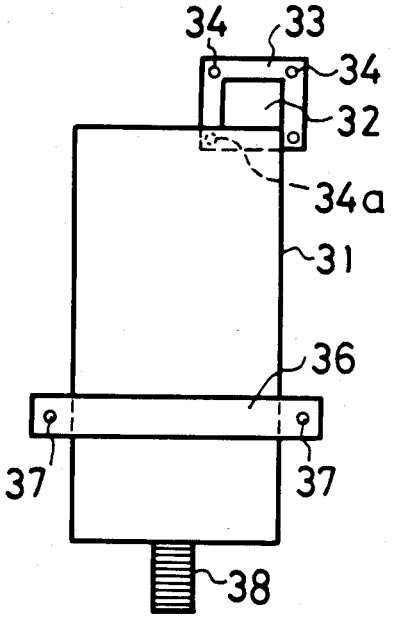
FIG. 18 is a top view of another embodiment of a converter of waveguide structure according to the present invention.
Figure 19:
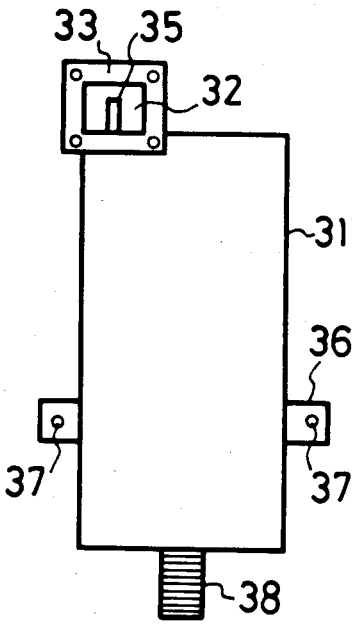
FIG. 19 is a rear view of the converter of FIG. 18.

FIGS. 18 and 19 illustrate an embodiment of the waveguide converter used in the above embodiments of the present invention. FIG. 18 is a plan view of such waveguide converter and FIG. 19 is its rear view (showing the rear surface to which the antenna is attached).

Referring to FIGS. 18 and 19, there is provided a converter main body 31 which has formed on its upper portion an input portion 32 so as to be connected to the planar array antenna (not shown). The input portion 32 is of a waveguide structure and has therearound a flange 33 used to attach the converter to the antenna. Tapped holes 34 are formed through the flange 33 at its four corners. Since one of these tapped holes 34a at the position nearest the converter main body 31 does not receive a screw, it is made in the form of, for example, a hemisherical-shaped convexity for positioning. A conversion probe 35 interconnected with the internal circuit in the converter 31 is projected into the inside of the input portion 32 as shown in FIG. 19. The converter main body 31 is fixed to the planar array antenna (not shown) by a belt 36 which has a pair of tapped holes 37 formed therethrough at its both ends. The converter main body 31 has an output connector 38 to which a coaxial cable (not shown) is connected.

Figure 20:
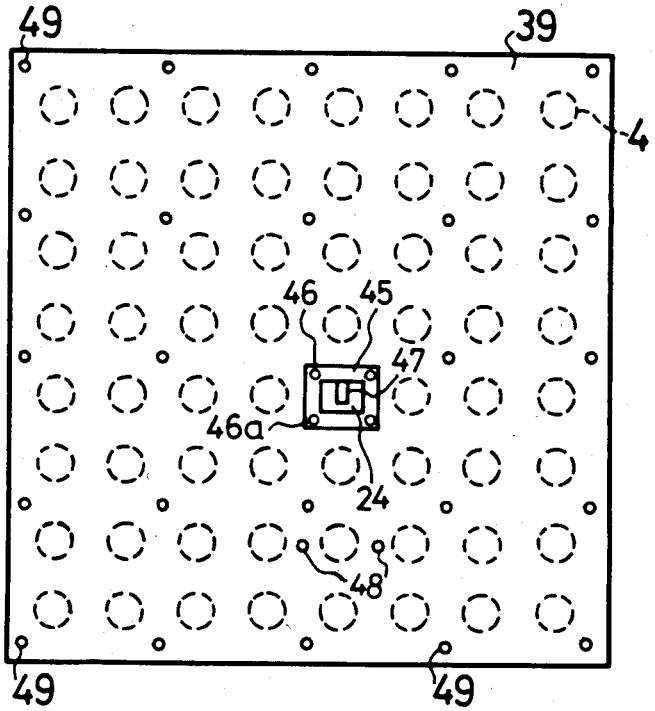
FIG. 20 is a rear view illustrating that the converter of FIG. 18 is attached to the antenna according to the present invention.
Figure 21:
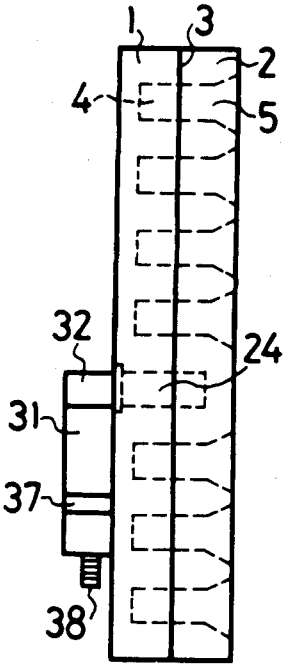
FIG. 21 is a side view of the apparatus of FIG. 20.

The waveguide converter described above is mounted on the planar array antenna in such a fashion as shown in FIGS. 20 and 21. FIG. 20 is a rear view of the planar array antenna (as seen from the rear surface to which the waveguide converter is attached) and FIG. 21 is a side view illustrating that the waveguide converter is attached to the planar array and antenna of this invention.

As described above, the planar array antenna comprises first and second metal plates (or metalized plastic plates) 1 and 2 and a thin film-shaped substrate (film-shaped flexible substrate) 3 sandwiched between the first and second metal plates 1 and 2. The first metal plate 1 has formed thereon a plurality of openings 4, each of which takes the form of concavity or concave depression. The second metal plate 2 has formed thereon a plurality of openings 5 of the same diameter as that of the opening 4 and each of which is formed as a concial shaped opening at its upper portion. Then, the openings 4 and 5 are communicated with each other. When the substrate 3 is sandwiched between the first and second metal plates 1 and 2, the openings 4 and 5 coincide with each other in axial alignment when positioned accurately.

Further, the feed portion 24 is provided on the antenna at its place where one centrally located radiation element is removed. This feed portion 24 protrudes to the rear surface of the planar array antenna (the left-hand side of FIG. 21).

A recess portion 45 is formed on the exposed or rear surface of the first metal plate 1 around the feed portion 24 and is shaped in the form corresponding to the flange 33. This recess portion 45 is made to have a concave depression substantially corresponding to the thickness of the flange 33. Tapped holes 46 are formed through the recess portion 45 at its three corners in alignment with the tapped holes 34 of the flange 33. A concave portion 46a is formed at the remaining one corner of the recess portion 45 in alignment with the convex portion 34a of the flange 33. A conversion probe 47, interconnected to the conductive foil (not shown) is projected into the inside of the feed portion 24. Tapped holes 48 are formed through the first metal plate 1 at its rear surface in association with the openings 37 of the belt 36. Further, a plurality of tapped holes 49 are formed through the first metal plate 1 at its rear surface to fix the first and second metal plates 1 and 2 to each other. Of course, a plurality of tapped holes (not shown) are formed through the substrate 3 and the second metal plate 2 in association with these tapped holes 49.

The waveguide converter is mounted on the planar array antenna as follows.

Placing the converter main body 31 along the rear surface of the first metal plate 1 and disposing the flange 33 into the recess portion 45, the convex portion 34a and the concave portion 46a are engaged with each other for positioning. Then, the tapped holes 34, 46 and the openings 37, 48 are made coincident with each other, through which are then inserted screws (not shown), to attach the converter to the antenna. Then, the conversion probe 35 in the input portion 32 contacts with the conversion probe 47 of the feed portion 24, whereby the planar antenna and the converter are electrically connected.

Figure 23:
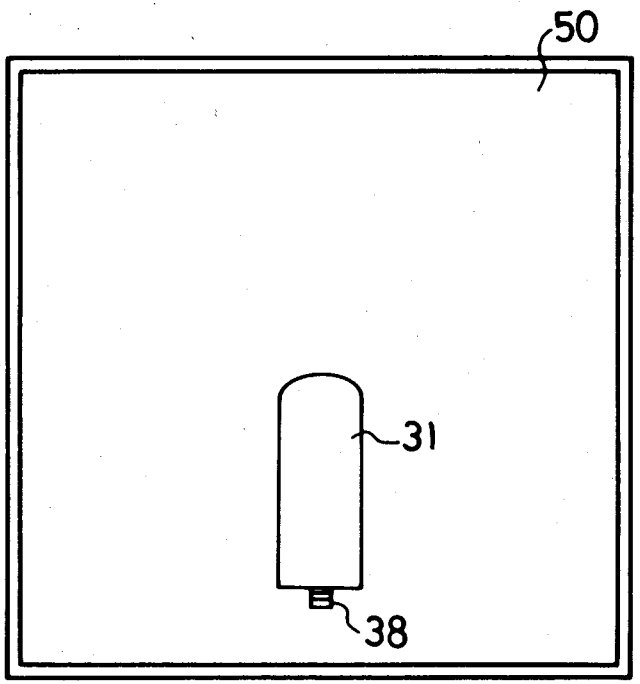
FIG. 23 is a rear view of FIG. 22.
Figure 22:
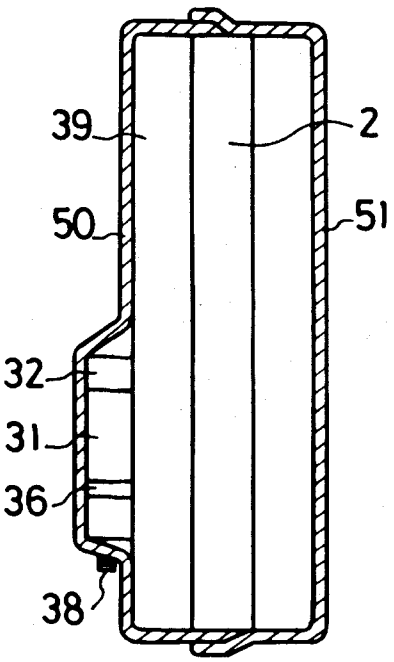
FIG. 22 is a side view showing an overall arrangement of the embodiment shown in FIGS. 18 to 21.

FIGS. 22 and 23 illustrate a cover 50 and a randome 51 which are attached to the planar array antenna having the waveguide converter 31 mounted on its rear surface. FIG. 22 is a side view thereof and FIG. 23 is its rear view. The cover 50 may be made of plastic material such as fiber reinforcing plastic of excellent weather-proof property. The radome 51 may be made of plastic material which little attenuates, for example, high frequency electromagnetic waves and which is also excellent in its weather-proof property. The second metal plate 2 and the radome 51 form therebetween a space of predetermined dimension to reduce any reflection loss.

According to the embodiment of the present invention shown in FIGS. 18 to 23, since the feed portion of waveguide structure is mounted on the rear surface of the antenna and combined with the converter of waveguide input configuration at the rear surface of the antenna so as to decrease its thickness, the antenna can be attached with ease, the freedom in attaching the antenna in any desired manner can be increased, and mechanical conditions such as wind pressure load can be alleviated, as compared with the conventional antennas such as a parabolic antenna or the like.

Furthermore, since the antenna is substantially exposed only at its planar array antenna portion, the planar array antenna portion, the planar array antenna can be protected from snowfall and does not require as much space to be mounted.

In one embodiment of the filter of FIG. 15, the widths of the several gaps are 0.1 mm, 0.5 mm, 1 mm, 1 mm, 0.5 and 0.1 mm from the upper gap downwards. In one embodiment of the filter of FIG. 16, the corresponding gap widths are 0.5 mm, 1 mm, 1 mm and 0.5 mm.

The above description is given on the preferred embodiments of the invention but it will be apparent that many modifications and variations could be effected by one skilled in the art without departing from the spirit or scope of the novel concepts of the invention so that the scope of the invention should be determined by the appended claims only.

We claim as our invention:

1. A suspended line feed type planar array antenna having a substrate sandwiched between a pair of conductive plates, a plurality of suspended lines on said substrate, each of said plates having a plurality of spaced openings defining radiation elements, a plurality of said openings having at least one excitation probe on said substrate, means for connecting signals received at said at least one excitation probe to a suspended line in phase with each other, a holding portion for holding said substrate formed on said conductive plate around the periphery of each of said plurality of openings and a groove portion of wide width formed on said conductive plates between adjacent ones of said openings, said groove portion having a plurality of said suspended lines located in parallel to each other therein.

2. Apparatus according to claim 1, wherein said openings are circular and said holding portion around each of said openings for holding said substrate is annular.

3. Apparatus according to claim 1, wherein said conductive plates have a rectangular shape and have said holding portion on the outer pheripheries thereof.

4. Apparatus according to claim 1, wherein said means for connecting comprises suspended line connecting means for connecting a plurality of said excitation probes to a feed point.

5. Apparatus according to claim 4, wherein said feed point is located at an aperture, and another holding portion of said conductive plate is provided around said aperture.

6. Apparatus according to claim 4, wherein a filter is provided between said feed portion and said suspended line.

7. Apparatus according to claim 6, wherein said filter is a bandpass filter of a suspended line configuration.

8. Apparatus according to claim 1, including a line width of a portion where a single suspended line is independently provided has an increased width.

9. Appratus according to claim 1, further comprising a feed portion of a waveguide structure provided on the rear surface of said antenna and a converter structure attached to the rear surface of said antenna, said feed portion and said converter being integrally formed into a thin single physical unit.

10. Apparatus according to claim 9, wherein said feed portion is located centrally on the array.

11. A suspended line feed type planar array antenna having a substrate sandwiched between a pair of conductive plates, a plurality of suspended lines on said substrate, each of said plates having a plurality of spaced openings defining radiation elements, a plurality of said openings have a pair of excitation probes formed perpendicular to each other in a common plane, on said substrate, in alignment with said openings, means for connecting signals received at said pair of excitation probes to a suspended line in phase with each other, a holding portion for holding said substrate formed on said conductive plate around the periphery of each of said plurality of openings, and a groove portion of wide width formed on said conductive plates between adjacent ones of said openings, said groove portion having a plurality of said suspended lines located in parallel to each other therein.

* * * * *